US007534143B1

(12) United States Patent
Tsao et al.

(10) Patent No.: US 7,534,143 B1
(45) Date of Patent: May 19, 2009

(54) ELECTRICAL CONNECTOR WITH IMPROVED WIRE TERMINATION ARRANGEMENT

(75) Inventors: Pei Tsao, Fullerton, CA (US); Chong Yi, Mechanicsburg, PA (US); Kuan-Yu Chen, Harrisburg, PA (US); Gary E. Biddle, Carlisle, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/985,676

(22) Filed: Nov. 16, 2007

(51) Int. Cl.
*H01R 13/648* (2006.01)

(52) U.S. Cl. ..... 439/610; 439/497

(58) Field of Classification Search ..... 439/610, 439/497, 101, 108, 578, 660
See application file for complete search history.

(56) References Cited

U.S. PATENT DOCUMENTS

| | | | | |
|---|---|---|---|---|
| 6,869,308 | B2 * | 3/2005 | Wu | 439/497 |
| 7,021,971 | B2 | 4/2006 | Chou et al. | |
| 7,104,848 | B1 | 9/2006 | Chou et al. | |
| 7,108,560 | B1 | 9/2006 | Chou et al. | |
| 7,125,287 | B1 | 10/2006 | Chou et al. | |
| 7,134,884 | B2 | 11/2006 | Wang et al. | |
| 7,422,488 | B1 * | 9/2008 | Wu | 439/676 |
| 7,462,071 | B1 * | 12/2008 | Wu | 439/608 |
| 2004/0115988 | A1 * | 6/2004 | Wu | 439/497 |
| 2005/0075009 | A1 * | 4/2005 | Ko | 439/579 |
| 2006/0025015 | A1 | 2/2006 | Hu et al. | |
| 2006/0261474 | A1 | 11/2006 | Jiang et al. | |
| 2006/0286865 | A1 | 12/2006 | Chou et al. | |
| 2006/0294272 | A1 | 12/2006 | Chou et al. | |

FOREIGN PATENT DOCUMENTS

| | | |
|---|---|---|
| CN | 2891389 Y | 4/2007 |
| CN | 2922162 Y | 7/2007 |
| CN | 2930014 Y | 8/2007 |

* cited by examiner

*Primary Examiner*—Gary F. Paumen
(74) *Attorney, Agent, or Firm*—Wei Te Chung

(57) ABSTRACT

An electrical connector (100) includes an insulative housing (2) extending in a front-to-back direction, a conductive shell (7) enclosing the insulative housing and cooperating with the insulative housing to define a receiving cavity (101) adapted for receiving a complementary connector, a first set of contacts (3) held in the insulative housing for transmitting a first kind of signals, a second set of contacts (4) held in the insulative housing and comprising two pairs of differential contacts (41) respectively for transmitting and receiving a second kind of signals and a grounding contact (42), a first set of wires (51) and a second set of wires (52). Each first contact includes a contacting section (36) exposed in the receiving cavity and a tail section (35) extending rearward from the contacting section. Each of the second set of contacts includes a contacting section (43) exposed in the receiving cavity and a tail section (45) extending rearward form the contacting section. The first set of wires are aligned in one row and have inner conductors (510) electrically connecting with the tail sections of the first set of contacts. The second set of wires are aligned in one row and include a pair of differential pairs (521) electrically connecting with the two pairs of differential contacts for transmitting and receiving the second kind of signals and at least one grounding conductor (522) electrically connecting with the grounding contact.

20 Claims, 16 Drawing Sheets

ELECTRICAL CONNECTOR WITH IMPROVED WIRE TERMINATION ARRANGEMENT

CROSS-REFERENCE TO RELATED APPLICATIONS

This application is related to U.S. patent application Ser. No. 11/818,100, filed on Jun. 13, 2007 and entitled "EXTENSION TO UNIVERSAL SERIAL BUS CONNECTOR WITH IMPROVED CONTACT ARRANGEMENT", and U.S. patent application Ser. No. 11/982,660 filed on Nov. 2, 2007 and entitled "EXTENSION TO ELECTRICAL CONNECTOR WITH IMPROVED CONTACT ARRANGEMENT AND METHOD OF ASSEMBLING THE SAME", both of which have the same assignee as the present invention.

BACKGROUND OF THE INVENTION

1. Field of the Invention

The present invention relates to an electrical connector, more particularly to an electrical connector in accordance with standard Universal Serial Bus (USB) 3.0 connector.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

The existing USB connectors have a small size but low transmission rate, while other non-USB connectors (PCI Express, SATA, et al) have a high transmission rate but large size. Neither of them is desirable to implement modern high-speed, miniaturized electronic devices and peripherals. To provide a kind of connector with a small size and a high transmission rate for portability and high data transmitting efficiency is much desirable. Such kind electrical connectors are disclosed in a U.S. Pat. No. 7,021,971 (hereinafter 971 patent) issued on Apr. 4, 2006. Detailed description about these connectors is made below.

From the FIGS. 4A-6H and detailed description of 971 patent, we can find that the invention material of 971 patent is to extend the length of the plug and receptacle tongue portions of the existing USB connectors and to extend depth of the receiving cavity of the existing USB connectors, thereby to accommodate additional contacts in extended areas as shown in FIGS. 4A-5H of 971 patent; or to provide the additional contacts on a reverse-side of the plug tongue portion and accordingly with regard to receptacle, to provide a lower tongue portion under a top receptacle tongue portion thereby four USB contacts are held on the top tongue portion and additional contacts are accommodated on the lower tongue portion of the receptacle. With contrast with existing USB type-A receptacle, the receptacle with top and lower tongue portion is higher in height than existing USB receptacle.

As shown in FIGS. 4C, 4D, 5C, 5D and 6C, 6D of the 971 patent, number of the additional contacts is eight. The eight additional contacts plus the four USB contacts are used collectively or in-collectively for PCI-Express, SATA or IEEE 1394 protocol as required. To make the extended-USB plug and receptacle capable of transmitting PCI-Express or SATA or IEEE 1394 signals is the main object of the 971 patent. To achieve this object, at least eight contacts need to be added. Adding eight contacts in existing USB connector is not easy. May be, only embodiments shown in 971 patent are viable options to add so many contacts. As fully discussed above, the receptacle equipped with two tongue portions or plug and receptacle both with a longer length are also clumsiness. That is not very perfect from a portable and small size standpoint.

A non-final draft of Universal Serial Bus 3.0 Connectors and Cable Assemblies Specification is published on May 6, 2007 which discloses Super A type, Super B type and Super AB type USB 3.0 receptacles, plugs and wire arrangement. Such specification meets current demands of transmitting high speed and low speed signals simultaneously or respectively. However, details of how to arrange the termination between wires and terminals are not specified in the non-final specification. Thus, an electrical connector with improved wire termination arrangement is developed to meet current demands.

BRIEF SUMMARY OF THE INVENTION

Accordingly, an object of the present invention is to provide an electrical connector with improved wire arrangement.

In order to achieve the above-mentioned object, an electrical connector comprises an insulative housing extending in a front-to-back direction, a conductive shell enclosing the insulative housing and cooperating with the insulative housing to define a receiving cavity adapted for receiving a complementary connector, a first set of contacts held in the insulative housing for transmitting a first kind of signals, a second set of contacts held in the insulative housing and comprising two pairs of differential contacts respectively for transmitting and receiving a second kind of signals and a grounding contact, a first set of wires and a second set of wires. Each first contact comprises a contacting section exposed in the receiving cavity and a tail section extending rearward from the contacting section. Each of the second set of contacts comprises a contacting section exposed in the receiving cavity and a tail section extending rearward form the contacting section. The first set of wires are aligned in one row and have inner conductors electrically connecting with the tail sections of the first set of contacts. The second set of wires are aligned in one row and comprise a pair of differential pairs electrically connecting with the two pairs of differential contacts for transmitting and receiving the second kind of signals and at least one grounding conductor electrically connecting with the grounding contact.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
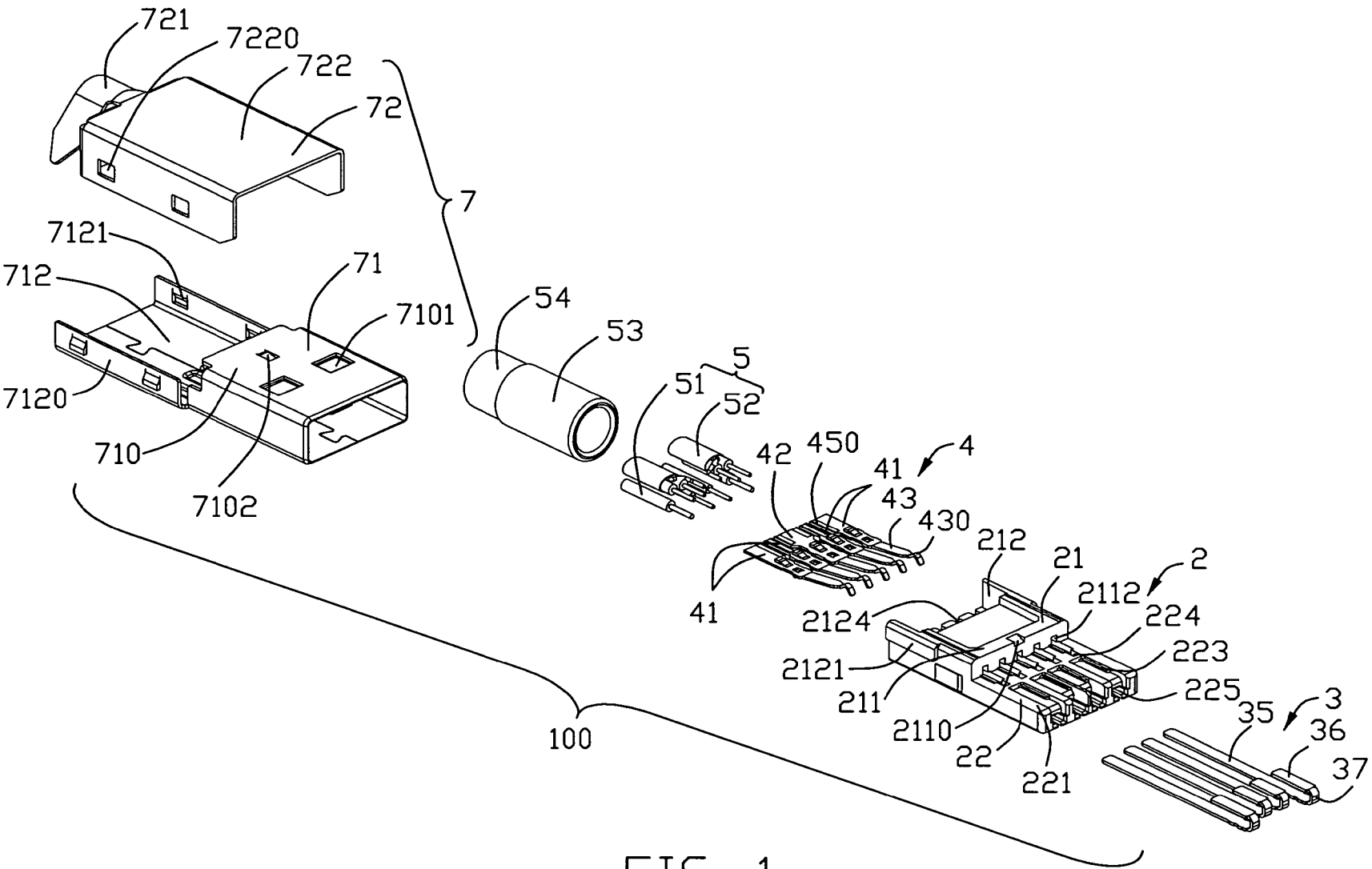
FIG. 1 is an exploded, perspective view of an electrical connector in accordance with the first embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Within the following description in accordance with the first, second and third embodiment of the present invention, a standard USB connector, plug, and signaling all refer to the USB architecture described within the Universal Serial Bus Specification, 2.0 Final Draft Revision, Copyright December, 2002, which is hereby incorporated by reference herein. USB is a cable bus that supports data exchange between a host and a wide range of simultaneously accessible peripherals. The bus allows peripherals to be attached, configured, used, and detached while the host and other peripherals are in operation. This is referred to as hot plugged.

Referring to FIGS. 1-6, an electrical connector 100, that is a USB plug 100, according to the first embodiment of the present invention is disclosed. The USB plug 100 comprises an insulative housing 2 which has an insulative base portion 21 and an insulative tongue portion 22 extending from the insulative base portion 21 in a front-to-rear direction, a first set of contacts 3 and a second set of contacts 4 supported in the insulative housing 2, and a metal shell 7 enclosing the insulative housing 2 and the contacts 3, 4. Besides, a cable 5 is provided to have first and second sets of wires 51, 52 to electrically connect with the contacts 3, 4. An outer jacket 53 is provided to bound the first and second sets of wires 51, 52 with a metal braid layer 54 formed by wires 51, 52 electrically connecting the metal shell 7 to provide shielding function. In order to provide a strong structure of the USB plug 100, an outer insulative cover 6 is over molded on a rear section of the insulative housing 2 together with the metal shell 7 and the cable 5. The outer insulative cover 6 is adapted for being grasped by a user when the USB plug 100 is used. Detail description of these elements and their relationship and other elements formed thereon will be detailed below.

Referring to FIGS. 1-5, the base portion 21 and the tongue portion 22 of the insulative housing 2 are integrally injecting molded as a unit one piece. The base portion 21 comprises a front engaging section 211 for engaging with the metal shell 7 and a rear terminating section 212 for the termination between the contacts 3, 4 and the wires 51, 52. The engaging section 211 defines a cutout 2110 in upper surface thereof and adjacent to a front surface thereof for engaging with the metal shell 7. Four first passageways 2111 and five second passageways 2112 are arranged in an upper row and a lower row to protrude through the engaging section 211 of the base portion 21 for receiving the first and second sets of contacts 3, 4. The rear termination section 212 is of U-shape and comprises a pair of lateral walls 2121 and a transversal flat board 2122 connecting with the lateral wall 2121. Four first channels 2123 and five second channels 2124 respectively aligning with the first and second passageways 2111, 2112 are respectively defined in lower and upper surfaces of the flat board 2122 for exposing tail portions of the first and second sets of contacts 3, 4 for soldering with the first and second set of wires 51, 52.

The tongue portion 22 has a first supporting surface 221 lower than the upper surface of the base portion 21 and opposite second supporting surface 222 coplanar with lower surface of the base portion 22. Four first passages 223 and five second passages 224 respectively recess downwardly from the first supporting surface 221 of the tongue portion 22 and are arranged in a front row and communicating with the first passageways 2111 in height direction and a rear row aligning with the second passageways 2112 in front-to-back direction. Four tip openings 225 are recessed rearward from front surface of the tongue portion 22 to communicate with the first passages 223 and the first passageways 2111 for exposing corresponding parts of the first set of contacts 3.

Referring to FIGS. 1-4, the first set of contacts 3 include four plug conductive contacts designated with numeral 31, 32, 33 and 34. The four first contacts 3 are assembled to the insulative housing 2 along a front-to-back direction. Each first contact 3 comprises a rear flat body section 35 received in the first passageway 2111 with rear tail section 350 thereof exposed in the first channel 2123, a flat contacting section 36 exposed in the first passage 223 and substantially coplanar with the first supporting surface 221, and a vertical arc-shape connecting section 37 connecting with the body section 35 and the contacting section 36 and exposed in the tip opening 225 of the tongue portion 22. A plurality of barbs 352 are formed with opposite side edges of the front end of the body section 35 for interferentially engaging with the first passageways 2111 to retain the first set of contacts 3 in the insulative housing 2 reliably. The four first contacts 3 are juxtaposed arranged and the contacting sections 36 thereof are nonelastic. The body section 35 is parallel to the contacting section 36 and is much longer than the contacting section 36. In addition, an arrangement of the four first set of contacts 31, 32, 33 and 34 is compatible to that of the standard USB receptacle. The four first contacts 31, 32, 33 and 34 are for USB protocol to transmit USB signals. In detail, the four first set of contacts 31, 32, 33 and 34 are for power (VBUS) signal, –data signal, +data signal and grounding, respectively. So now, from assignment of each first contacts standpoint, different terminology are given to each of the four first set of contacts 31, 32, 33 and 34, wherein the first contacts 31, 32, 33 and 34 are respectively named as power contact 31, –data contact 32, +data contact 33 and ground contact 34. To realize the power (VBUS) and grounding transmission, the connecting sections 37 of the first and fourth contacts 31, 34 locate closer to the front surface of the tongue portion 22 than that of the second and third contacts 32, 33.

The additional second set of contacts 4 include two pairs of differential contacts 41 and a grounding contact 42 located between the two pairs of differential contacts 41 for preventing cross-talk. The two pairs of differential contacts 41 are used for transferring/receiving high-speed signals. Each differential contact 41 of each pair comprises an elastic contacting section 43 formed with an elastic contacting end 430 curved upwardly, a middle retention portion 44 formed with a pair of retention tabs 440 arranged along front-to-back direction and a flat tail portion 45 extending rearwardly from the retention portion 44. The retention tabs 440 of each retention portion 44 bend toward opposite directions. The second contacts 4 are inserted into the insulative housing 2 from back-to-front direction with the retention portions 44 interferentially engaging with inner walls of the second passageways 2112 via the retention tabs 440, the elastic contacting sections 43 partially received in the second passages 224 and the contacting ends 430 exposed beyond the first supporting surface 221 of the tongue portion 22, and the tail portions 45 exposed in the termination section 212 and locating in the second channels 2124 for soldering with the second set of wires 52. The width of each tail portion 45 is different from one another. The width of the two outermost tail portions 45 of the pair of differential contacts 41 is wider than that of two relatively inner tail portions 45 of the pair of differential contacts 41 and narrower than that of tail portion 45 of the grounding contact 42. Each of the outermost tail portions 45 defines a wire-positioning slot 450 in an edge adjacent to the adjacent tail portion 45, and the relatively inner tail portion 45 is curved to form the wire-positioning slot 450, while, the tail portion 45 of the grounding contact 42 defines a pair of wire-receiving slots 450 in edges adjacent to the relatively inner tail portions 45 of the pair of differential contacts 41. Therefore, the wire-positioning slots 450 are divided into two groups which includes three ones. Thus, the differential contacts 41 and the grounding contact 42 are juxtaposed with respect to one another along the front-to-rear direction. The contacting sections 36 of the four first set of contacts 31, 32, 33 and 34 occupy a majority of length of the tongue portion 22 along the front-to-rear direction with respect to that of the contacting sections 43 of the additional second set of contacts 4. Meanwhile, the tail portions 45 are offset from the tail sections 350 of the first set of contacts 31, 32, 33 and 34 in a height direction perpendicular to the front-to-rear direction. The tail portions 45 are located under the tail sections 350 of the first set of contacts 31, 32, 33 and 34 to prevent electrical shorting. Besides, each contacting section 43 is cantilevered received in the second passages 224 and protrudes upwardly beyond the supporting surface 121 so that the contacting section 43 is elastic and deformable when engaging with corresponding contacts of an extension to USB receptacle (not shown). The contacting sections 43 and the contacting sections 36 are separated in the front-to-rear direction with no portion of them contacting one another.

The USB plug 100 is compatible to existing standard USB receptacle. The geometric profile of the tongue portion 22 is same as that of the standard USB plug within an allowable tolerance. That is, length, width and height of the tongue portion 22 are substantially equal to those of the standard USB plug. An arrangement of the four first set of contacts 31, 32, 33 and 34 is compatible to that of the standard USB receptacle as described above.

Referring to FIGS. 1-5, the metal shell 7 comprises a lower first half 71 and an upper second half 72 engaging with the first half 71 to form the whole metal shell 7. The first half 71 comprises a front tube-shape mating frame 710 and a rear U-shape holding section 712 with opposite flanges 7120 each formed with a pair of tubers 7121 bending outwardly for engaging with locking holes 7220 of the second half 72 to secure the first and second halves 71, 72. The front mating frame 710 defines two pairs of rectangular windows 7101 in upper and lower walls thereof and a rear locking opening 7102 in upper wall adjacent to the holding section 712. The second half 72 is assembled to the rear holding section 712 of the first half 71 and comprises a n-shape front holding section 720 and a rear crimping section 721 for grasping the metal braid layer 54 to realize strain relief. The holding section 722 forms two pairs of locking holes 7220 in opposite lateral walls thereof and a bending tab 7221 bending from a front edge of upper wall thereof to lock into the locking opening 7102 of the first half 71. After the metal shell 7 is assembled to the insulative housing 2 and the contacts 3, 4, the mating frame 710 of the metal shell 7 touches other three sides of the tongue portion 22 except the first supporting surface 221, thus, a receiving space 101 circumscribed by the mating frame 710 and the first supporting surface 221 is formed. The contacting sections 36 of the first set of contacts 3 and the contacting sections 43 of the second set of contacts 4 are all exposed in the receiving cavity 101 surrounded by the mating frame 710 and first supporting surface 221 for mating with corresponding contacting sections of a complementary connector. An arrangement of the metal shell 7 and the tongue portion 22 is also compatible with what of standard USB receptacle.

In the first embodiment of the present invention, the first set of contacts 3 are all formed of a metal sheet and separated form one another. It is also to be understood that, in other embodiments, the first contacts 31, 32, 33 and 34 can be conductive pads formed on a printed circuit board which is supported on the supporting surface 221 of the tongue portion 22. These two options to make contacts are both viable in current industry.

The cable 5 comprises the four first set of wires 51 arranged in a lower row to be soldered with the tail sections 350 of the first set of contacts 3 and a pair of second set of wires 52 arranged in an upper row to be soldered with the tail portions 45 of the second set of contacts 4. Each first set of wires 51 comprises an inner conductor 510 soldered with the tail section 350 and an outer jacket 512 enclosing the inner conductor 510. Each second set of wires 52 comprises a pair of differential pairs 521 each having the same structure as that of the first set of wires 51, a grounding conductor 522, and an outer jacket 523 enclosing the differential pair 521 and the grounding conductor 522. The exposed portions of the two differential pairs 521 of the second set of wires 52 are respectively partially received in the wire-receiving slots 450 and soldered to the tail portions 45 of the differential contacts 41. While the pair of grounding conductors 522 are arranged to angle from the outer jacket 523 and then be parallel to the differential pars 521, and thus, the pair of grounding conductors 522 are received in the pair of wire-receiving slots 450 and soldered to the single grounding contact 42. The metal shell 7 is assembled of the insulative housing 2, the contacts 3, 4 and the cable 5 as described above. Then, the outer insulative cover 6 is overmolded with the metal shell 7, the cable 5.

Figure 7:
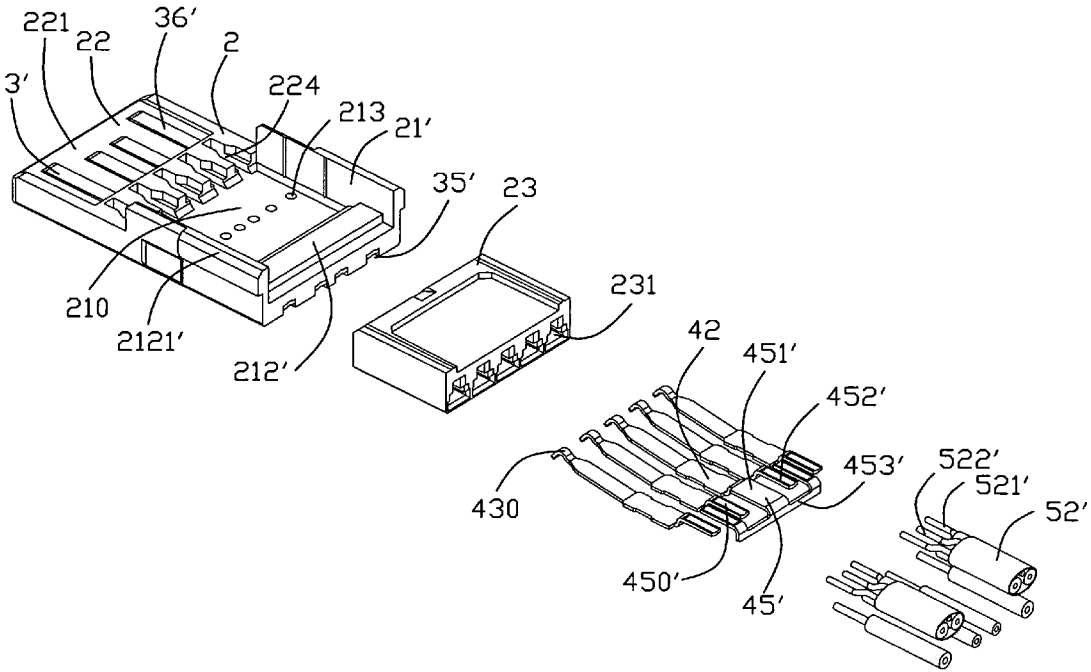
FIG. 7 is an exploded, perspective view of an insulative housing, contacts and wires in accordance with a second embodiment of the present invention.
Figure 8:
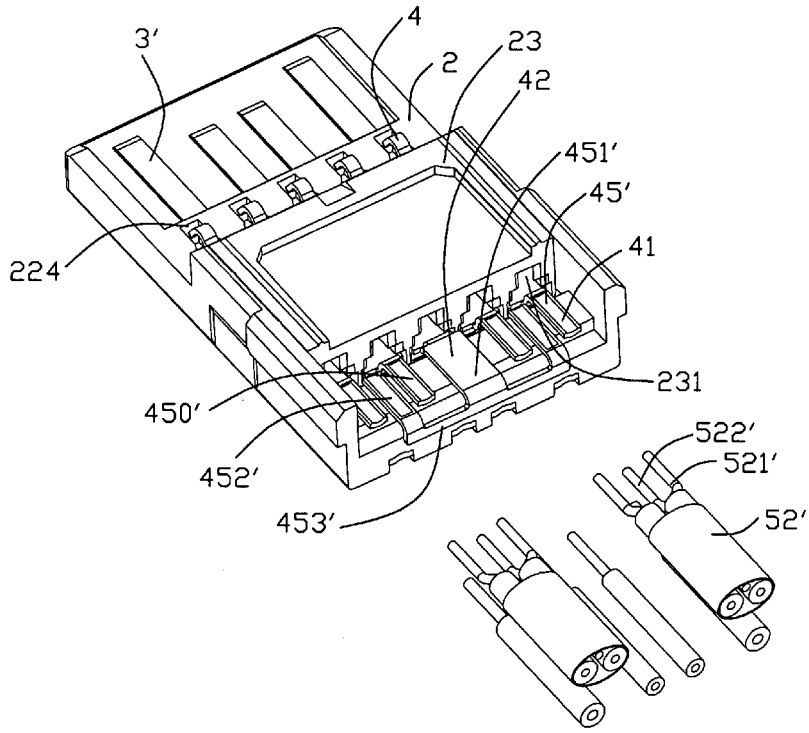
FIGS. 8-9 are partially assembled view and an assembled view of FIG. 7.
Figure 9:
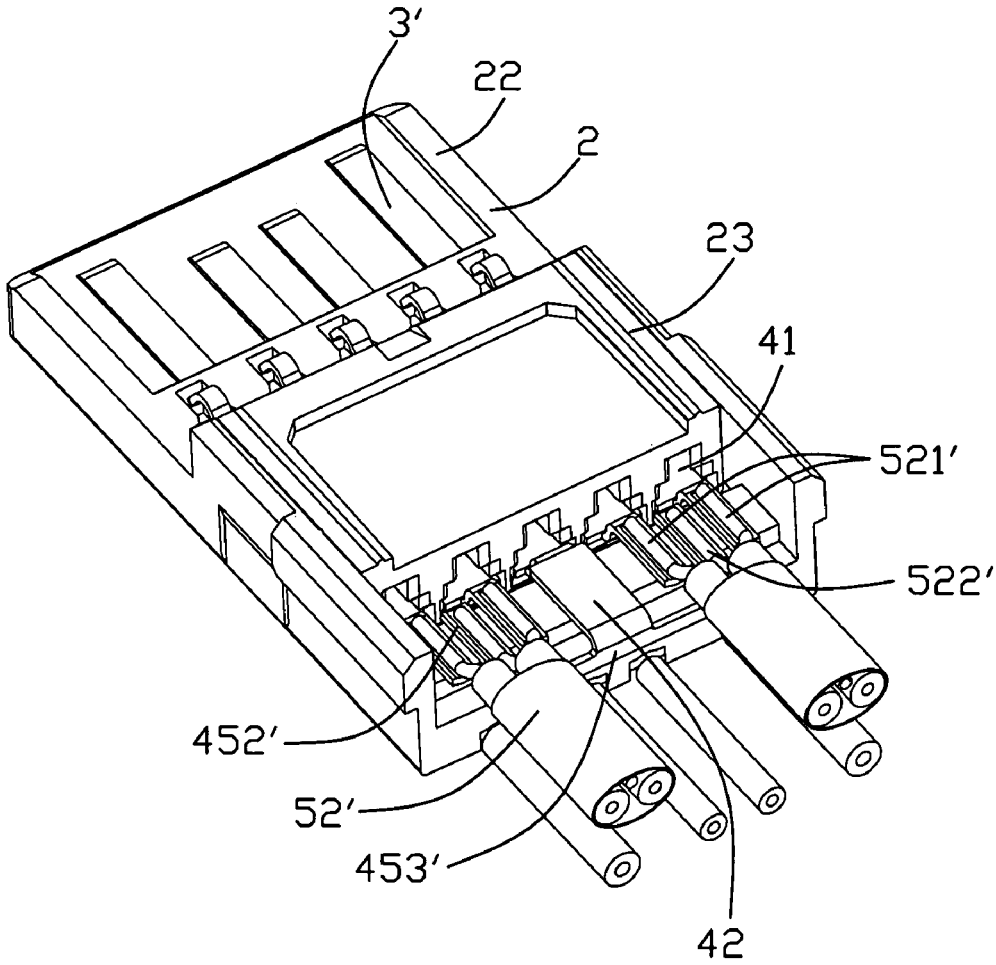

Please refer to FIGS. 7-9, a second embodiment of the present invention are shown. There are following differences between the first and second embodiments. Firstly, the first set of contacts 3' are inserted molded with the insulative housing 2 with flat mating sections 36' exposed outside to be substantially coplanar with the first supporting surface 221 for electrically connecting with a complementary connector and tail sections 35' exposed in lower surface of the base portion 21'. The insulative housing 2 defines a row of circular holes 213 for pins inserting through to sandwich the first set of contacts 3' when molding the insulative housing 2. The insulative housing 2 also defines a receiving cavity 210 opening toward outside formed by a pair of lateral walls 2121' and a step-shape termination section 212' at rear section thereof. The second set of contacts 4 are inserted into an additional insert 23 which providing a plurality of second passageways 231 to permit the second contacts 4 inserting through. The insert 23 is received in the receiving cavity 210 of the insulative housing 2 with the contacting ends 430 of the second set of contacts 4 exposed into the second passages 224 of the insulative housing 2, thus, achieving better deformation space for the contacting ends 430 along up-to-down direction. Other differences between the first and second embodiments exist in tail portions 45, 45' and the wire arrangement of the second set of wires 52. The tail portion 45' of the grounding contact 42 is wider than those of the differential contacts 41 which has the same shape and width as one another. The tail portions 45' of the differential contacts 41 are shaped into wire-receiving slots 450', while the tail portion 450' of the grounding contact 42 is of M-shape the structure and comprises a wider flat section 451', a pair of narrower branches 452' each locating between the tail portions 450' of each pair of differential contacts 41, and a transverse connecting section 453' connecting the flat section 451' and the pair of branches 452' and located in a vertical plane. Each branch 452' is also formed into a wire-receiving slot 450' parallel to the wire-receiving slots 450' of the differential contacts 41. In addition, each tail portion 45' of the differential contacts 41 is formed to be higher than the retention portions 44, thus, the branches 452' is substantially lower than the tail portions 45' of the differential contacts 41. Correspondingly, the grounding conductor 522' and the differential pair 521 are arranged into a triangle for being received and soldered in the wire-receiving slots 450' as shown in FIG. 8.

Figure 10:
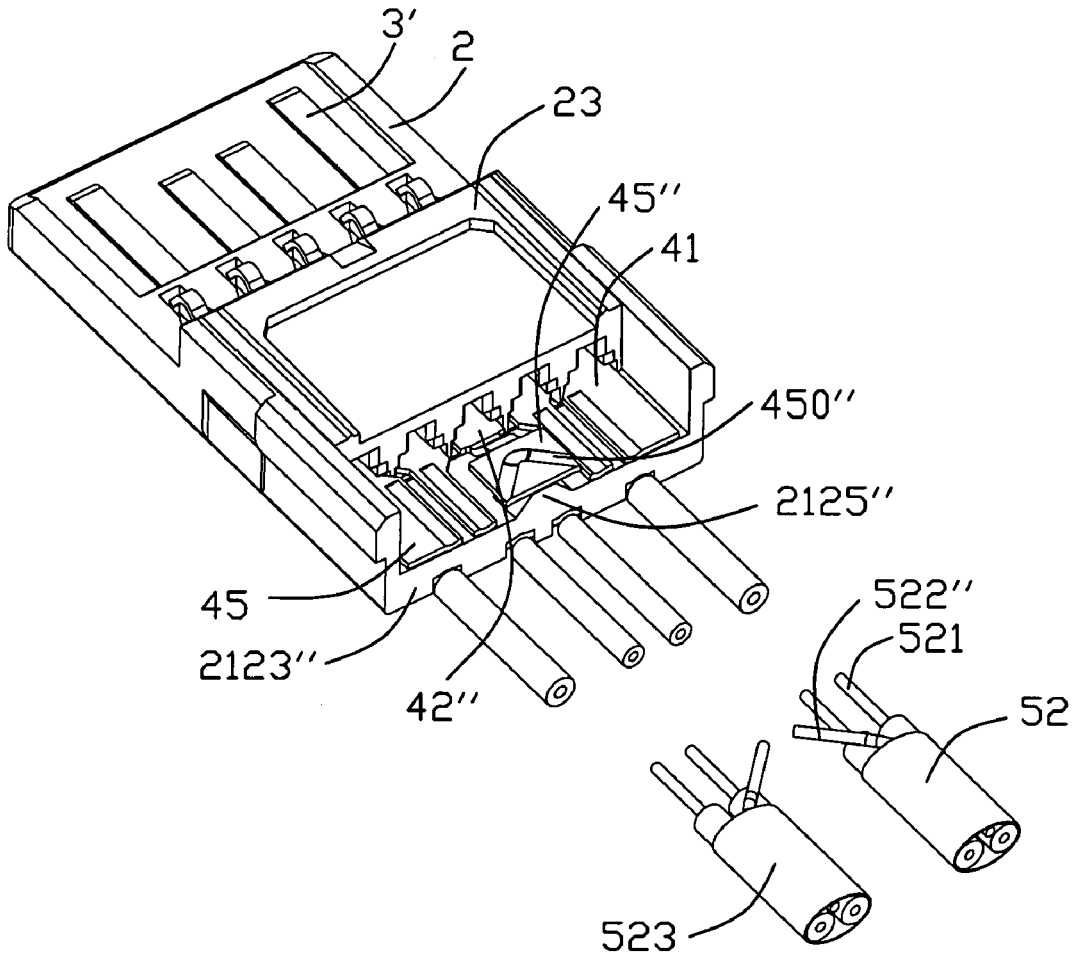
FIG. 10 is a partially exploded, perspective view of the insulative housing, the contacts, and wires in accordance with a third embodiment of the present invention.
Figure 11:
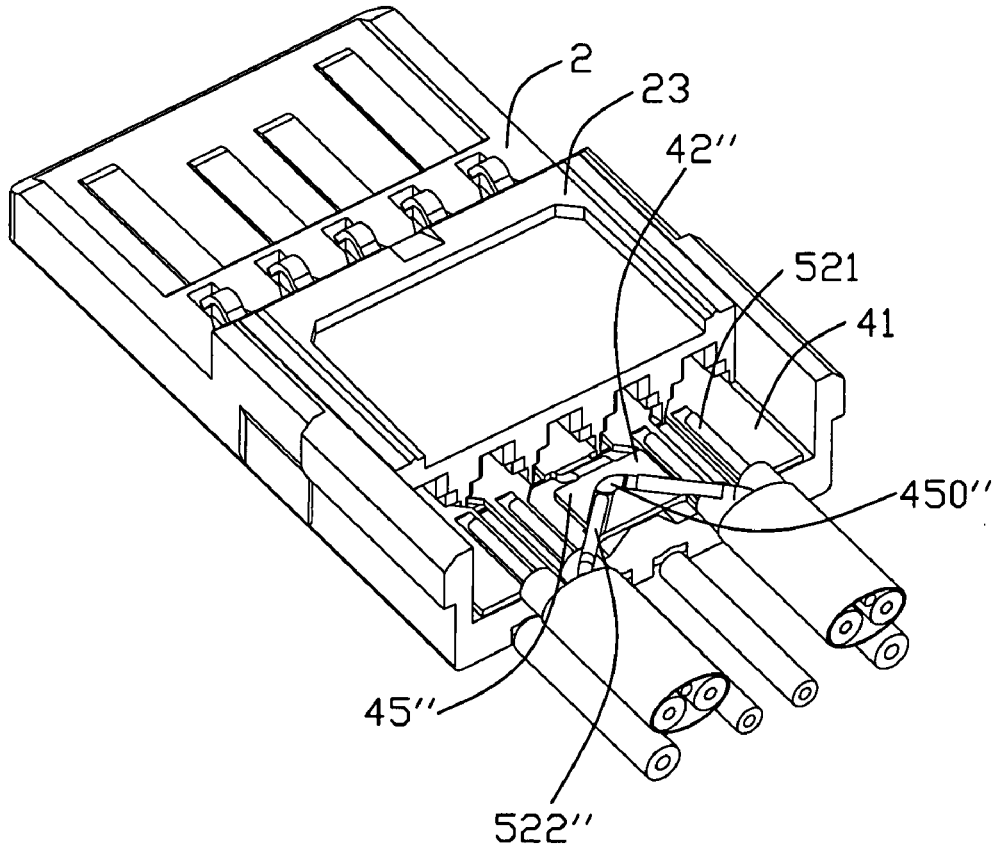
FIG. 11 is an assembled view of FIG. 10.
Figure 12:
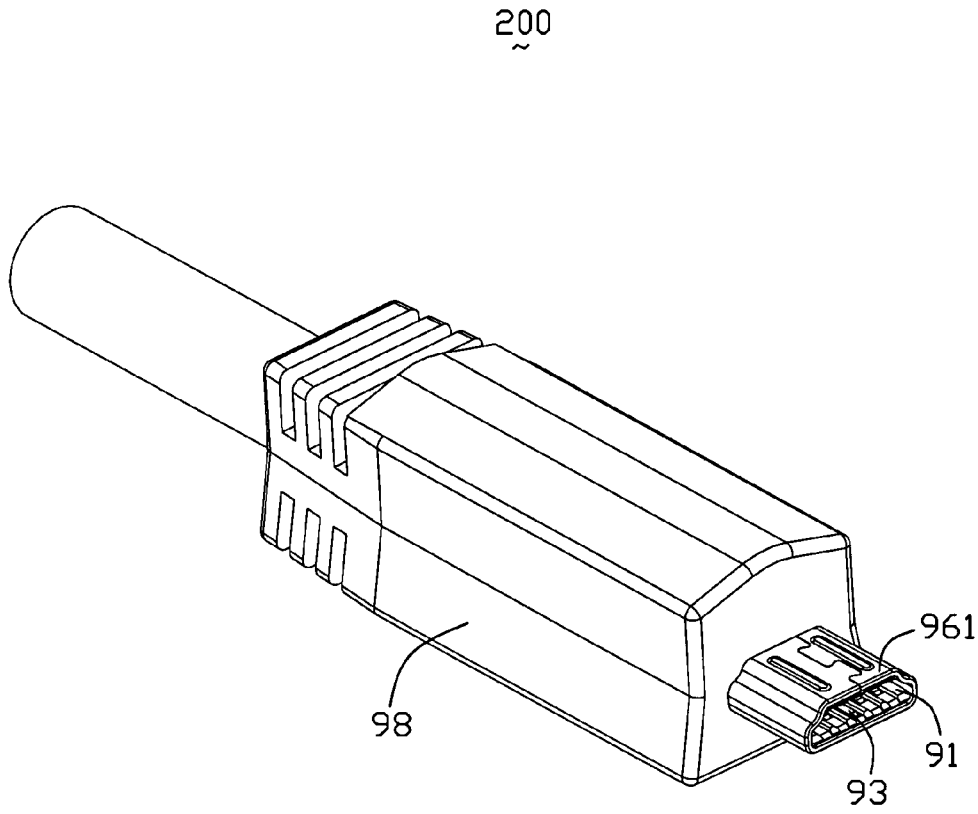
FIG. 12 is an assembled, perspective view of an electrical connector in accordance with the forth embodiment of the present invention.
Figure 13:
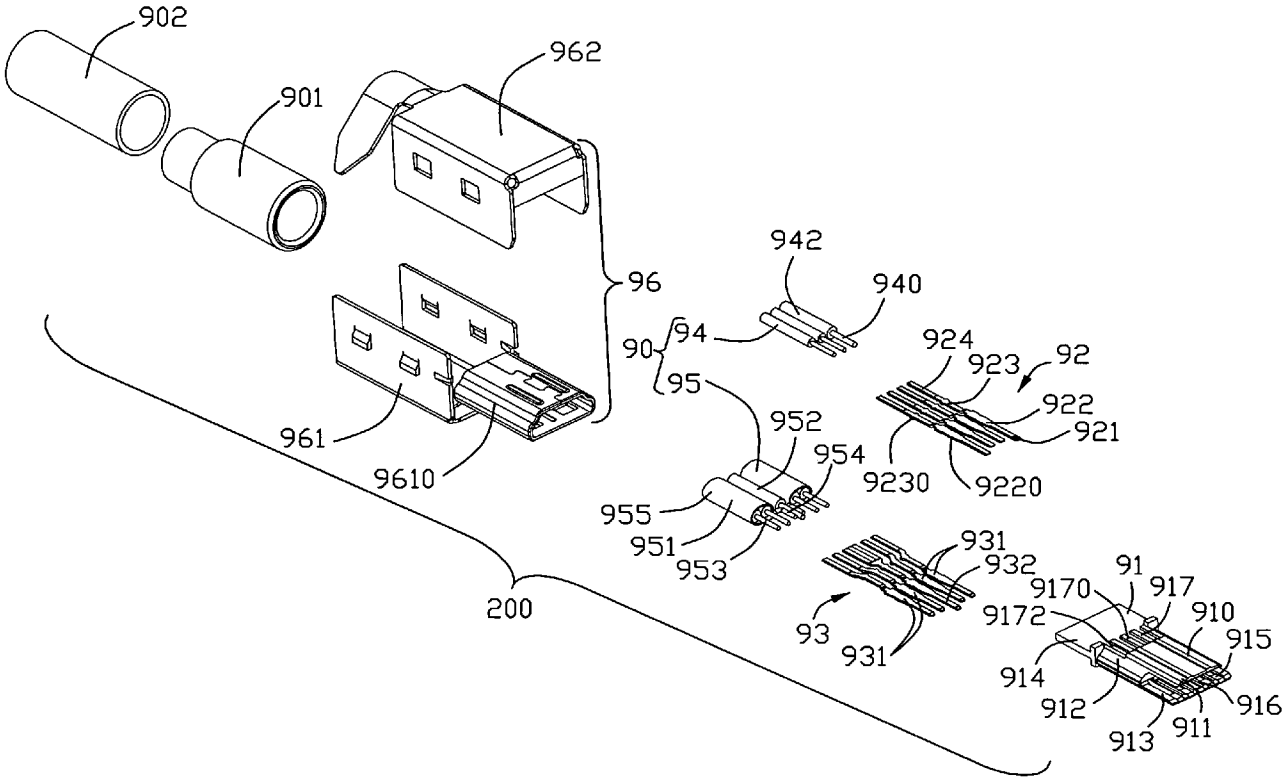
FIGS. 13-14 are exploded, perspective views of the electrical connector shown in FIG. 12, but viewed from different aspects.
Figure 14:
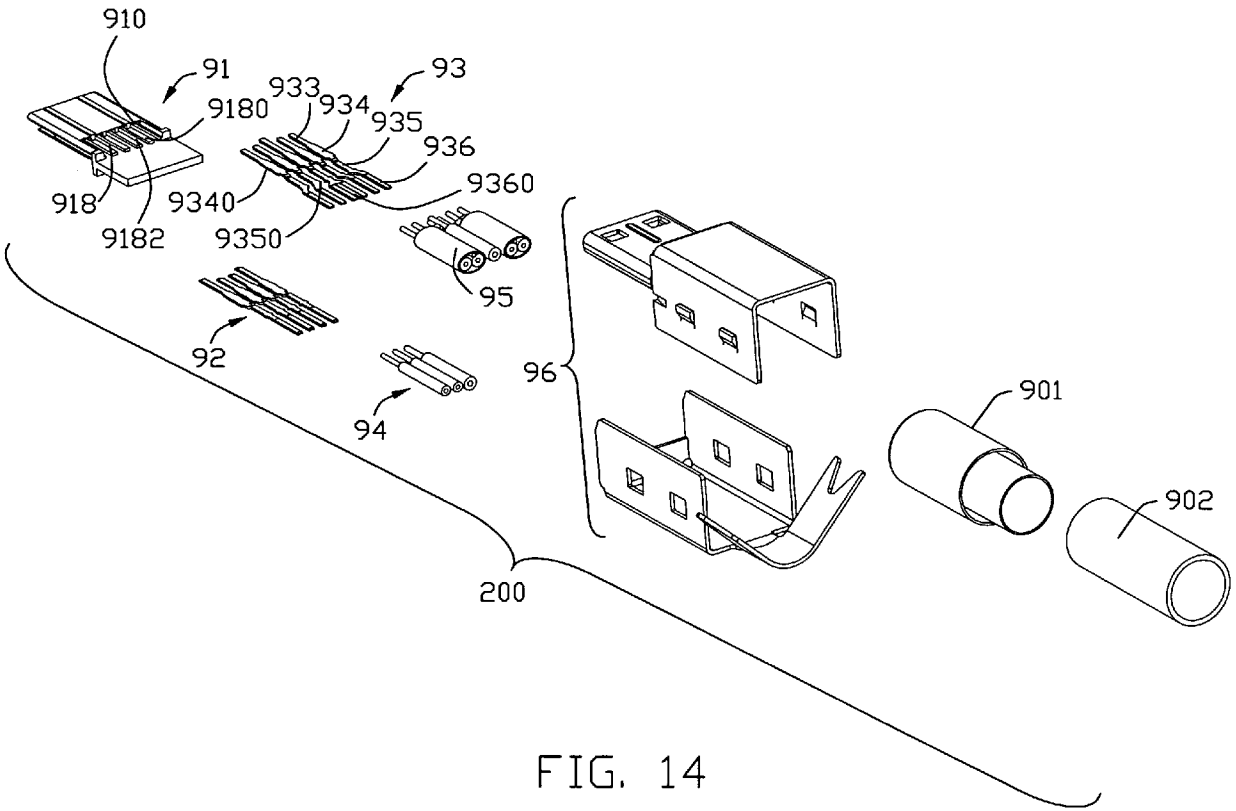
Figure 15:
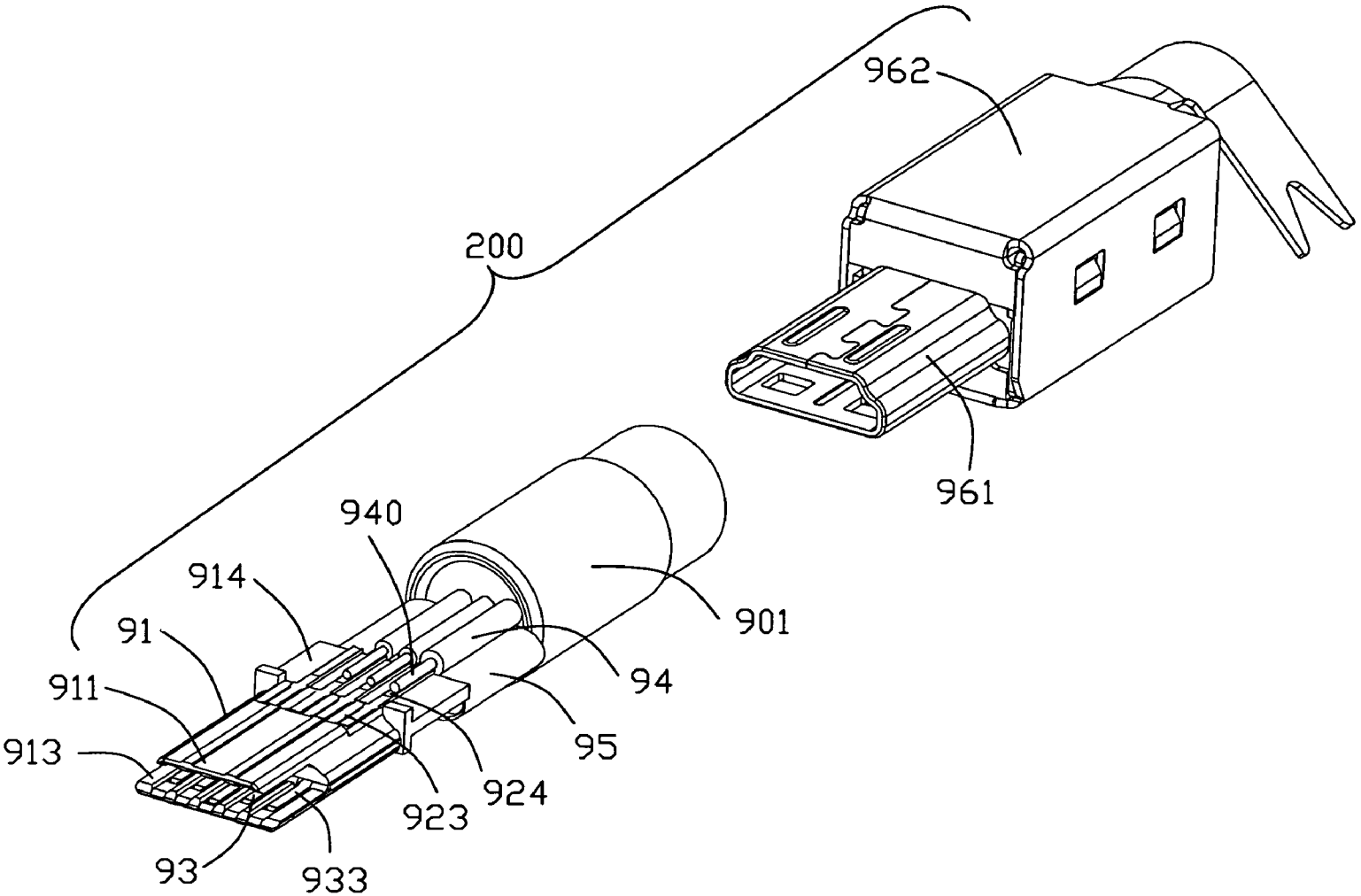
FIGS. 15-16 are partially assembled views of FIGS. 13-14.
Figure 16:
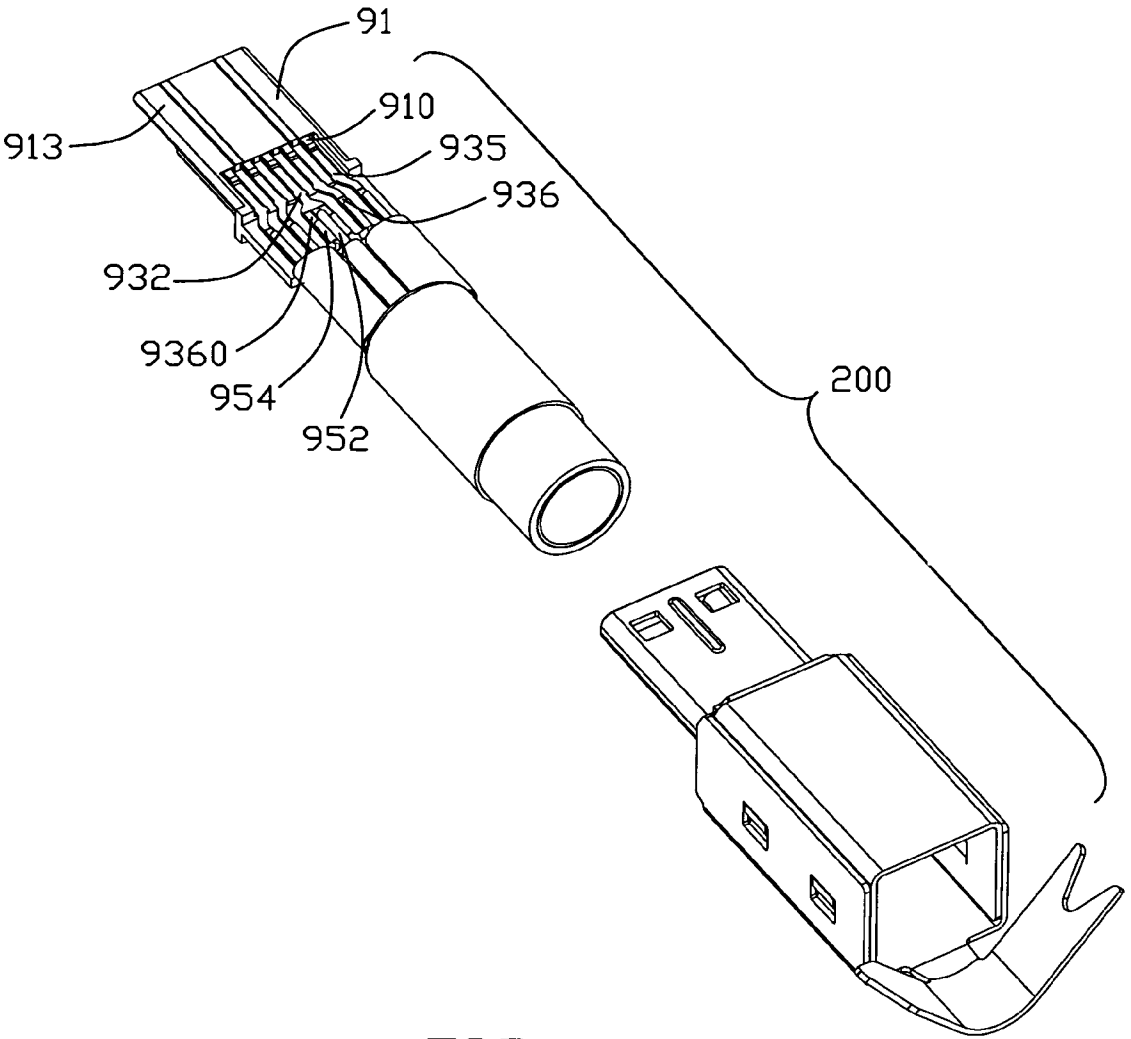

Please refer to FIGS. 10-11, a third embodiment of the present invention is shown. The differences between the first and third embodiments exist in the tail portion 45" of the grounding contact 42" and the wire arrangement of grounding conductors of the second set of wires 52. The flat board 2123" forms a wedge-shape protrusion 2125" below the tail portion 45" of the grounding contact 42" which is the widest one among the five tail portions 45, 45". Thus, the tail portion 45" of the grounding contact 42" is disposed higher than the tail portions 45 of the differential contacts 41; and that is to say, the tail portions 45" of the grounding contact 42" and the tail portions 45 of the differential contact 41 are arranged at different levels along a vertical direction. The tail portion 45" defines a pair of wire-receiving slots 450" communicating with each other and forming an angle therebetween. The grounding conductors 522" are angled out from the outer jackets 523 and toward each other to be received and soldered in the wire-receiving slots 450" of the tail portion 45" of the grounding contact 42".

Under the non-USB protocol, the two pairs of differential contacts 41 transfer differential signals unidirectionally, one pair for receiving data and the other for transmission data.

Figure 2:
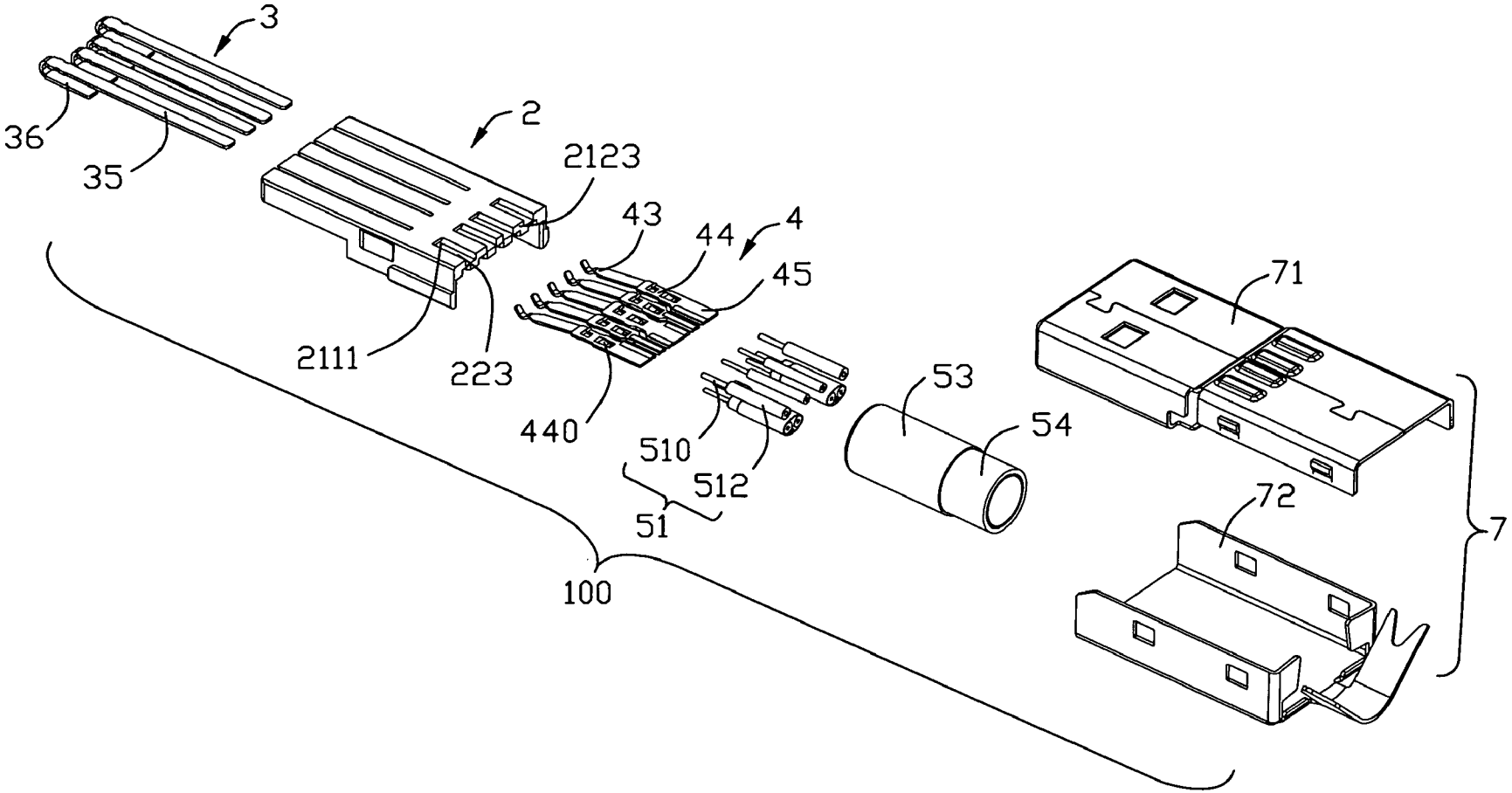
FIG. 2 is a view similar to FIG. 1, but viewed from a different aspect.
Figure 3:
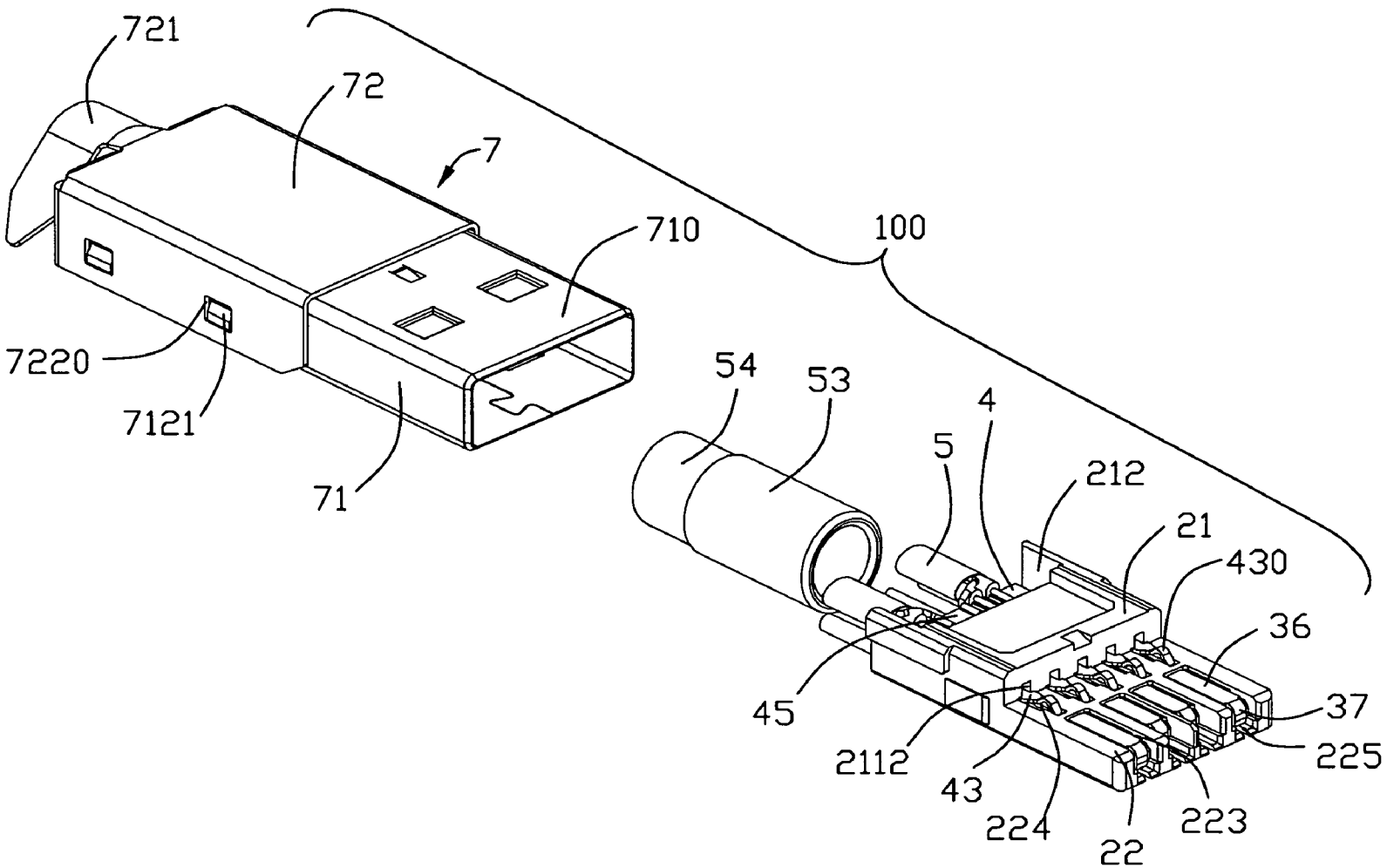
FIG. 3 is a partially assembled view of FIG. 1.
Figure 4:
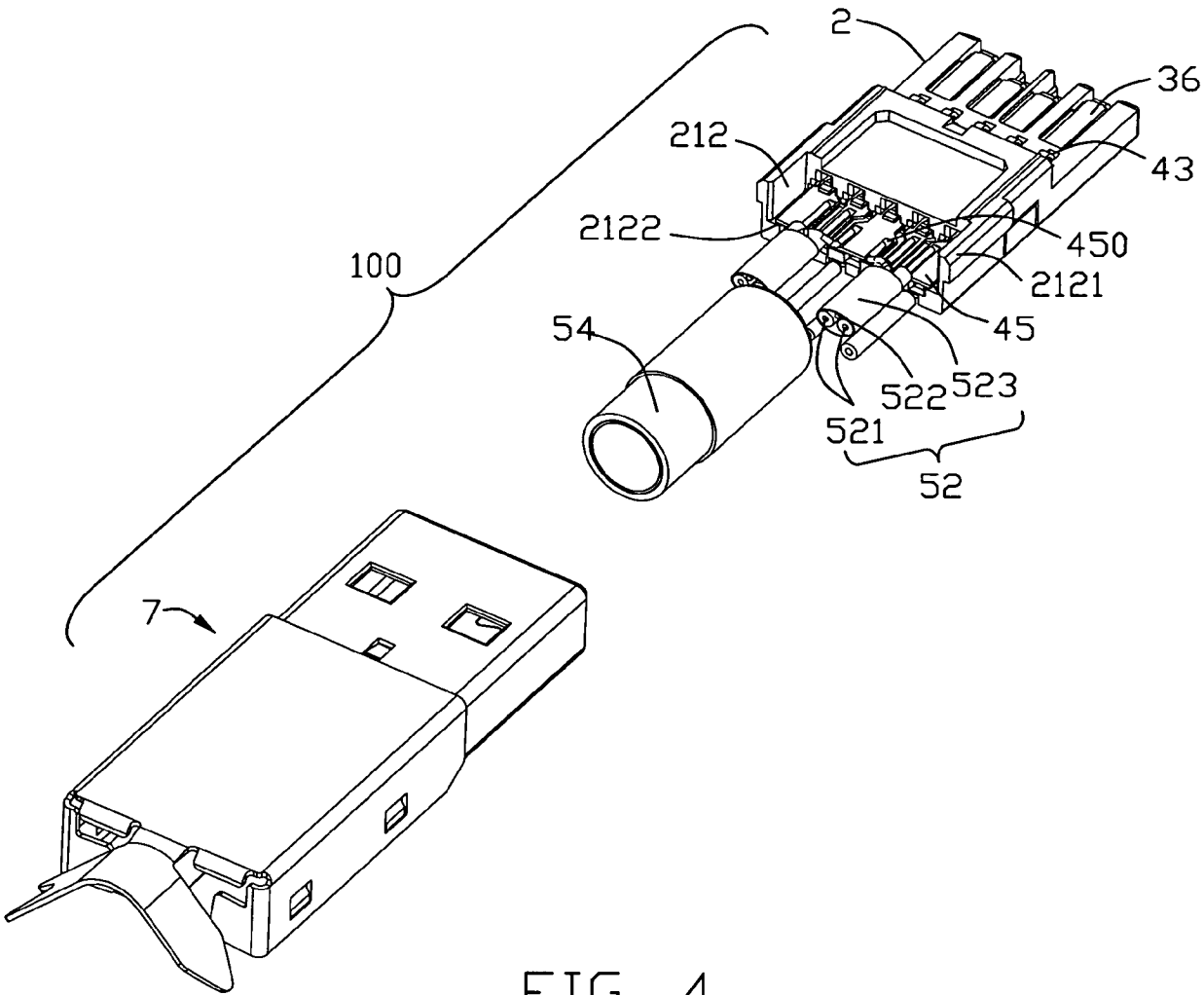
FIG. 4 is a view similar to FIG. 3, but viewed from a different aspect.
Figure 5:
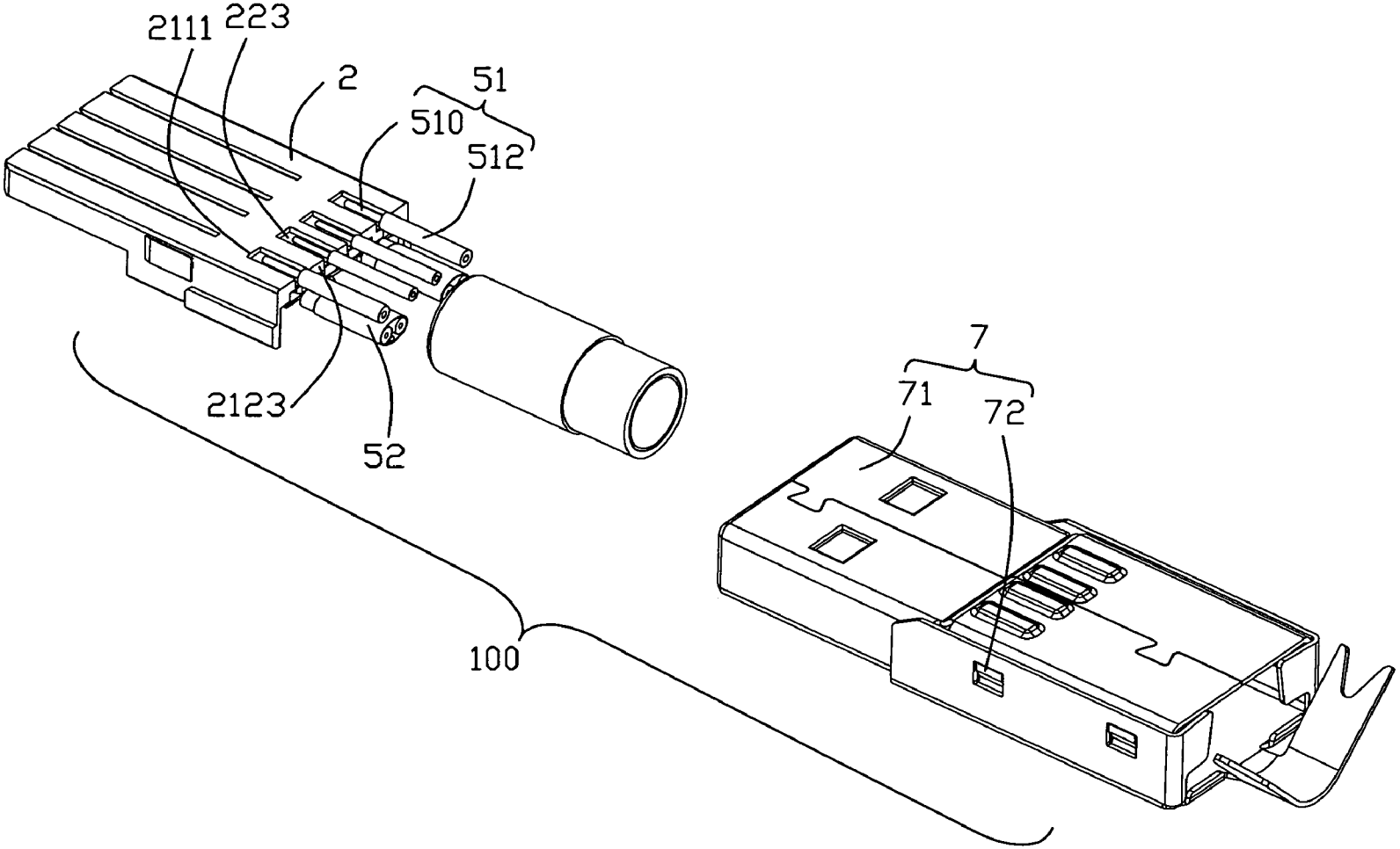
FIG. 5 is a partially assembled view of FIG. 2.
Figure 6:
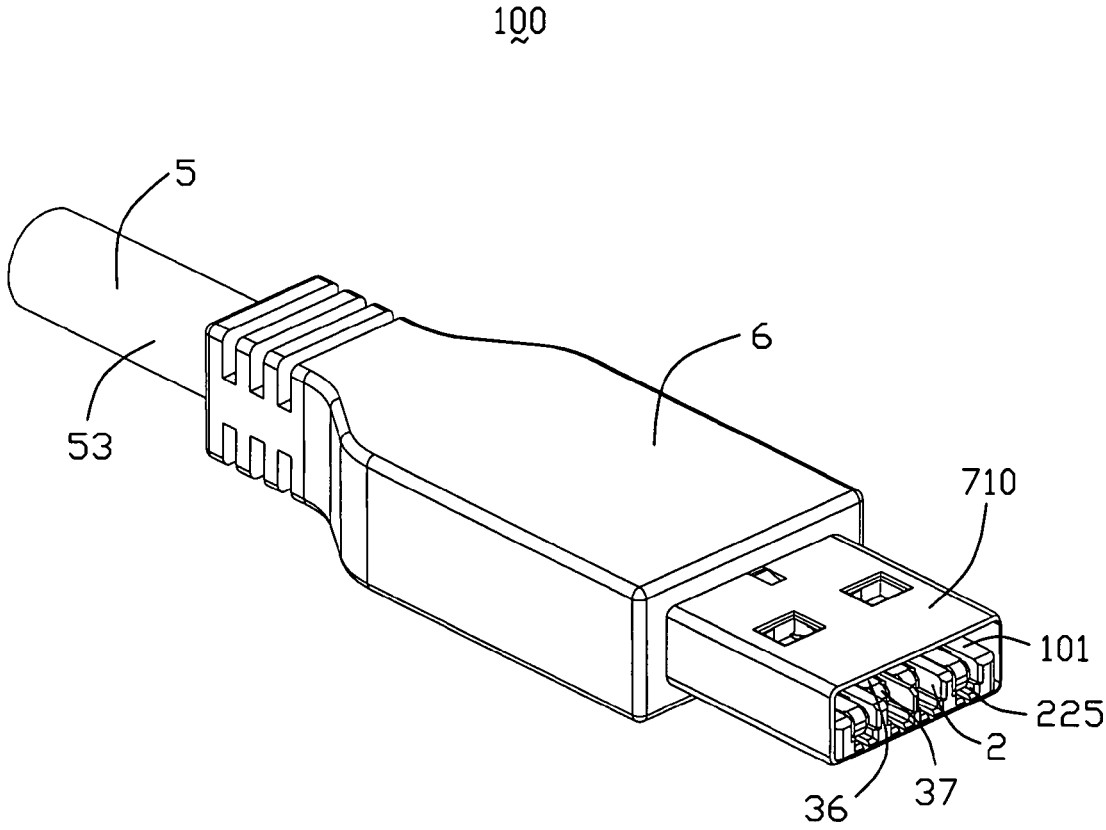
FIG. 6 is an assembled, perspective view of FIG. 1.

In the preferred embodiment of the present invention, the number of the additional second set of contacts 4 is five which consists of two pairs of differential contacts 41 and a grounding contact 42 disposed between each pair of the differential contacts 41 as best shown in FIGS. 1-3. However, in alternative embodiments, the additional second set of contacts 4 can only comprise a pair of differential contacts for transmitting/receiving high-speed signals, and if necessarily, a grounding contact can be provided to be positioned on each lateral side of the pair of differential contacts.

Please refer to FIGS. 12-16, a super B type USB 3.0 plug connector 200 in accordance with the forth embodiment of the present invention is disclosed. The plug connector 200 comprises an insulative housing 91, a first set of contacts 92 and a second set of contacts 93 supported in the insulative housing 91, and a metal shell 96 enclosing the insulative housing 91 and the contacts 92, 93. Besides, a cable 90 is provided to have first and second set of wires 94, 95 to electrically connect with the contacts 92, 93. An outer jacket 901 is provided to bound the first and second sets of wires 94, 95 with a metal braid layer 902 formed by wires 94, 95 electrically connecting the metal shell 96 to provide shielding function. In order to provide a strong structure of the USB plug 200, an outer insulative cover 98 is over molded on a rear section of the insulative housing 91 together with the metal shell 96 and the cable 90. The outer insulative cover 98 is adapted for being grasped by a user when the USB plug 000 is used. Detail description of these elements and their relationship and other elements formed thereon will be detailed below.

The insulative housing 91 comprises a front tongue portion 910, a middle base portion 912 and a rear termination portion 914 extending rearward from the base portion 912. The tongue portion 910 consists of an upper first tongue section 911 defining four first passages (not shown) respectively recessed upwardly from bottom surface thereof with different lengths along front-to-back direction according to the arrangement of the first set of contacts 92, and a lower second tongue section 913 defining five second passages 915 respectively recessed downward from upper surface thereof. The first and second tongue sections 911, 913 are parallel to each other to define a receiving space 916 therebetween for receiving a complementary connector with first and second passages communicating with the receiving space 916. The first tongue section 911 is shorter than the second tongue section 913 along transverse direction. The base portion 912 defines four first passageways (not shown) in front section thereof to align with the first passages and five second passageways 919 in front section thereof to align with the second passages 915. Top and bottom walls of the rear section of the base portion 912 are cutoff to form a first contact-alignment section 917 forming a plurality of ribs 9170 parallel arranged to define four first contact-alignment slots 9172, and a second contact-alignment section 918 forming a plurality of ribs 9180 parallel arranged to define five second contact-alignment slots 9182. The termination section 914 is a flat board extending rearward from a middle edge of the base portion 912.

The first set of contacts 92 include four plug conductive contacts for power (VBUS) signal, −data signal, +data signal and ID, respectively. The four first contacts 92 are assembled to the insulative housing 91 along a front-to-back direction. Each first contact 92 comprises a front flat mating section 921 received in corresponding first passage of the first tongue section 911 and exposed in the receiving space 916, a wider retention section 922 extending rearward from the mating section 921 and interferentially received in the first passageways of the base portion 912 via retention barbs 9220 on lateral edges thereof, a thinner leg section 923 extending rearward from the retention section 921 to be received in the first contact-alignment slots 9172 with barbs 9230 thereof interferentially engaging with the ribs 9170, and a tail section 92.4 shaped into a first set of wires-receiving slot and supported by upper surface of the termination section 914.

The first set of wires 94 comprises three wires in the present embodiment. Each first set of wires 94 comprises an inner conductor 940 and an outer jacket 942 enclosing the inner conductor 940 therein. The three inner conductors 940 are respectively received in the first set of wires-receiving slot and soldered to the tail section 924 of the first set of contacts 92 in the termination section 914 of the insulative housing 91 with the first contact 92 for ID is open. However, in an alternative embodiment, an additional first set of wires 94 may be provided to be soldered with the ID first contact 92 for other usage.

The additional second set of contacts 93 include two pairs of differential contacts 931 and a grounding contact 932 located between the two pairs of differential contacts 931 for preventing cross-talk. The two pairs of differential contacts 931 are used for transferring/receiving high-speed signals. Each differential contact 931 of each pair comprises a flat mating section 933 received in corresponding second passage 915 of the second tongue section 913 and exposed into the receiving space 916, a wider retention section 934 extending rearward from the mating section 933 and interferentially received in corresponding second passageway 919 via retention barbs 9340 on lateral edges thereof, a tail section 936 offset from corresponding mating section 933 of differential contact 931 or aligning with corresponding mating section 933 of the grounding contact 932 to be supported by a bottom surface of the termination section 914 of the insulative housing 91, and a thinner leg section 935 received in the second contact-alignment slots 9182 and interferentially engaging with the ribs 9180. The leg section 935 is formed into an L-shape to connect the retention section 934 and the tail section 936 of the differential contact 931 or straight shape to connect the retention section 934 and the tail section 936 of the grounding contact 932. The tail sections 936 of the differential contacts 931 have the same structure and each is formed into a second set of wires-receiving slot, while the tail section 936 of the grounding contact 932 has a wider width and defines three second set of wires-receiving slots 9360 for positioning wires.

The second set of wires 95 comprises a pair of shielded differential pairs 951 and a grounding wire 952 disposed between the differential pairs 951 and having the same structure as that of the first set of wires 94. Each differential pair 951 comprises a pair of signal wires 953 served as differential pair and having the same structure as that of the first set of wires 94, a grounding conductor 954 disposed to contact the signal wires 953, and an outer jacket 955 enclosing the signal wires 953 and the grounding conductor 954. The inner conductors of the signal wires 953 are received in the wire-receiving slots of the tail sections 936 of the differential contacts 931 and soldered thereto. The pair of grounding conductors 954 of the pair of shielded differential pairs 951 are bent toward the grounding wire 952 to be juxtaposed arranged with the grounding wire 952. Thus, the grounding conductors 954 and the inner conductor of the grounding wire 952 are received in and soldered to the three wire-receiving slots of the tail section 936 of the grounding contact 932.

The metal shell 96 comprises a first shell half 961 and a second shell half 962 combined with the first shell half 962 to enclose the insulative housing 91, the contacts 92, 93, front ends of the wires 94, 95 and the metal braid tube 97. The first shell half 961 forms a mating frame 9610 contacting the outer periphery of the first and second tongue sections 911. 913 and close the receiving space 916.

Although the grounding conductors of the second set of wires 95 are juxtaposed arranged, in alternative embodiments, means as shown in FIGS. 7-10 are also available.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector, comprising:

an insulative housing extending in a front-to-back direction;

a conductive shell enclosing the insulative housing and cooperating with the insulative housing to define a receiving cavity adapted for receiving a complementary connector; and a first set of contacts held in the insulative housing for transmitting a first kind of signals, each first contact comprising a contacting section exposed in said receiving cavity and a tail section extending rearward from the contacting section;

a second set of contacts held in the insulative housing and comprising two pairs of differential contacts respectively for transmitting and receiving a second kind of signals and a grounding contact, and each of the second set of contacts comprising a contacting section exposed in said receiving cavity and a tail section extending rearward form the contacting section; and a first set of wires aligned in one row and having inner conductors electrically connecting with the tail sections of the first set of contacts;

and a second set of wires aligned in one row and comprising a pair of differential pairs electrically connecting with the two pairs of differential contacts for transmitting and receiving said second kind of signals and at least one grounding conductor electrically connecting with the grounding contact.

2. The electrical connector as claimed in claim 1, wherein the grounding contact of the second set of contacts is arranged between the two pairs of differential contacts.

3. The electrical connector as claimed in claim 1, wherein the grounding conductor of the second set of wires is a pair of grounding conductors, and wherein each grounding conductor is disposed with one pair of differential pair to isolate from the other grounding conductor.

4. The electrical connector as claimed in claim 3, wherein the pair of grounding conductors of the second set of wires are both soldered to the single grounding contact.

5. The electrical connector as claimed in claim 3, wherein each grounding conductor and corresponding pair of differential pair are enclosed by an outer jacket, and wherein the exposed parts of the pair of grounding conductors are angled toward each other to be soldered with the same grounding contact.

6. The electrical connector as claimed in claim 3, wherein the tail section of the grounding contacts forms a pair of branches locating between the two tail sections of the same pair of differential contacts, and wherein the pair of grounding conductors are respectively soldered with the pair of branches to electrically connect the grounding contact.

7. The electrical connector as claimed in claim 3, further comprising a grounding wire comprising an inner conductor and an outer jacket enclosing the inner conductor, and wherein the inner conductor of the grounding wire and the pair of grounding conductors of the second set of wires are all soldered to the same grounding contact.

8. The electrical connector as claimed in claim 1, wherein the insulative housing forms a supporting surface, and wherein the contacting sections of the first and second sets of contacts are exposed in the supporting surface of the insulative housing.

9. The electrical connector as claimed in claim 1, wherein the contacting sections of the first set of contacts are nonelastic, and wherein the contacting sections of the second set of contacts are elastic and locate behind the contacting sections of the first set of contacts along the same side of the insulative housing.

10. The electrical connector as claimed in claim 1, wherein the first set of contacts are insert-molded with the insulative housing, and wherein the second set of contacts are assembled to the insulative housing.

11. The electrical connector as claimed in claim 10, further comprising an insert assembled to the insulative housing, and wherein the second set of contacts are assembled to the insert to be assembled to the insulative housing.

12. The electrical connector as claimed in claim 1, wherein the insulative housing comprises a first tongue section and a second tongue section parallel to the first tongue section, and wherein the contacting sections of the first set of contacts are held in the first tongue section and the contacting sections of the second set of contacts are held in the second tongue section and facing to the contacting sections of the first set of contacts.

13. The electrical connector as claimed in claim 1, wherein the contacting sections of the first and second contacts are nonelastic.

14. The electrical connector as claimed in claim 1, wherein the second tongue section is longer than the first tongue section with the number of the second set of contacts is larger than that of the first set of contacts.

15. An electrical connector, comprising:

an insulative housing extending in a front-to-back direction;

a first set of contacts held in the insulative housing for transmitting a first kind of signals, each first contact comprising a contacting section and a tail section extending rearward from the contacting section;

a second set of contacts held in the insulative housing and comprising two pairs of differential contacts respectively for transmitting and receiving a second kind of signals and a grounding contact, and each of the second set of contacts comprising a contacting section and a tail section extending rearward form the contacting section;

a first set of wires having inner conductors electrically connecting with the tail sections of the first set of contacts; and a second set of wires comprising a pair of differential pairs electrically connecting with the two pairs of differential contacts for respectively transmitting and receiving said second kind of signals and more than one grounding conductors; and the tail portions of the differential contacts and the grounding contact of the second set of contacts arranged at different levels;

the differential pairs of the second set of wires respectively soldered to the tail portions of the differential contacts, and the grounding conductors of the second set of wires soldered to the tail portion of the grounding contact.

16. The electrical connector as claimed in claim 15, wherein the grounding conductors adjacent a rear portion of the insulated housing are deflected toward each other and soldered to the tail portion of the grounding contact.

17. The electrical connector as claimed in claim 15, wherein the tail portion of the grounding contact is wider than the tail portion of the differential contacts.

18. A cable connector assembly comprising:

an insulative housing defining a mating port;

five contacts disposed in the housing with resilient contacting sections exposed upon the mating port under a condition that a middle one is a grounding contact and the two by each side of said grounding contact are signal contacts;

two pairs of differential pair cables located behind the cable and connected to the corresponding contacts, respectively, each differential pair including a pair of signal lines and a grounding line;

said middle contact defining an enlarged or extended soldering section so as to have both grounding lines of said two pair of different pair cables commonly soldered thereon.

19. The electrical connector as claimed in claim 18, wherein the soldering section of the grounding contact is located at a different level with regard to those of the signal contacts under a condition that the all said soldering sections of both said grounding contact and said signal contacts are located in line along a transverse direction.

20. The electrical connector as claimed in claim 19, wherein the soldering section of the grounding contact is higher than those of said signal contacts.

* * * * *